United States Patent [19]

Aria et al.

[11] Patent Number: 4,819,733

[45] Date of Patent: Apr. 11, 1989

[54] AUTOMATIC FIRE EXTINGUISHING EQUIPMENT

[75] Inventors: Yoshio Aria, Sagamihara; Kouji Akiba; Akira Kitajima, both of Yokohama, all of Japan

[73] Assignee: Hochiki Corp., Tokyo, Japan

[21] Appl. No.: 841,937

[22] Filed: Mar. 20, 1986

[30] Foreign Application Priority Data

Mar. 26, 1985 [JP] Japan ..... 60-61719

[51] Int. Cl.[4] ..... A62C 37/18

[52] U.S. Cl. ..... 169/61; 169/60; 340/519; 340/578; 250/554; 250/342

[58] Field of Search ..... 169/60, 61, 26, 52; 340/518, 519, 578; 250/342, 554; 364/550, 551

[56] References Cited

U.S. PATENT DOCUMENTS 3,588,893 6/1971 McCloskey ..... 169/61
4,023,146 5/1977 Carroll ..... 340/519 X
4,609,048 9/1986 Tasaki et al. ..... 169/61

FOREIGN PATENT DOCUMENTS 98235 1/1984 European Pat. Off. ..... 169/61
2106385 4/1983 United Kingdom ..... 169/61

*Primary Examiner*—Sherman D. Basinger
*Assistant Examiner*—Paul E. Salmon
*Attorney, Agent, or Firm*—Lackenbach Siegel Marzullo & Aronson

[57] ABSTRACT

This invention relates to an automatic fire extinguishing equipment adapted to direct a nozzle towards the position of a flame starting within a supervising zone so as to discharge a fire extinguishing liquid to extinguish the flame, which equipment comprises a flame detecting apparatus including a detecting element for detecting a flame and device for scanning and driving the detecting element in a horizontal direction and a vertical direction, for searching the supervising zone and outputting data concerning the flames; a storage section for storing the detection data from the flame detecting apparatus; a fire extinguishment controlling section which decides the sizes of the distributed flames on the basis of the storage data from said storage section; a nozzle assembly including the nozzle and device for controlling the direction of the nozzle in response to a control from the fire extinguishment controlling section.

6 Claims, 7 Drawing Sheets

AUTOMATIC FIRE EXTINGUISHING EQUIPMENT

FIELD OF THE INVENTION AND RELATED ART

This invention relates to an automatic fire extinguishing equipment.

The inventors of the present invention have previously proposed an automatic fire extinguishing equipment wherein a pair of flame detecting apparatuses are driven when a fire starting in a supervising zone is detected, a size of the flame is determined according to the computation on the basis of detection information from the flame detecting apparatuses, and a nozzle is directed, when the size exceeds a predetermined level, to the position of the flame and discharge a fire extinguishing liquid so as to extinguish the fire.

In such an automatic fire extinguishing equipment, in order to quickly detect a flame starting in the supervising zone, the supervising zone is divided into two so as to allot them to the pair of flame detecting apparatuses, respectively, so that the respective flame detecting apparatuses may effect flame detection in the respectively alloted supervising regions. When one of the flame detecting apparatuses detects a flame, the other flame detecting apparatus stops its flame detection operation and is made to be directed towards the flame detected. Thus, detection information is obtained from each of the flame detecting apparatuses and the distance to the flame and the size of the flame are computed by utilizing a trigonometrical survey on the bases of the obtained detection informations. The nozzles are directed according to the computation result, i.e., to the position of the flame first detected and discharges fire extinguishing liquid thereto.

However, if the supervising zone includes a construction material of high reflectance, such as a mirror, a window pane, etc., a light energy radiated from the flame is reflected from the mirror or the window pane and incident upon the flame detecting apparatus. Thus, there is brought such a situation as if two flames, i.e., an actual flame and a virtual flame image obtained by the reflection from the mirror or the window pane exist. In such a situation, if the flame detecting apparatus first detects the virtual flame image, a predetermined detection operation will be carried out without determining as to whether it is an actual flame or a virtual flame image. And, if the size of the virtual image flame is larger than the predetermined size, the fire extinguishing action will be taken by directing the nozzles to the virtual image flame and discharging the fire extinguishing liquid thereto. In such a case, not only the fire extinguishing liquid is wasted, but also so called a water damage due to the extinguishing liquid is caused. Furthermore, there is more serious problem that the actual flame will spread in the mean time and will possibly cause fatal damages.

OBJECTS AND SUMMARY OF THE INVENTION

It is an object of the present invention to provide an automatic fire extinguishing equipment which is capable of automatically distinguishing a flame starting within the supervising zone from a virtual image of the flame obtained through reflection by a water surface, a mirror, a window pane, etc. and capable of directing a nozzle to the position of the actural flame for effecting a fire extinguishing operation.

The automatic fire extinguishing equipment of the present invention comprises a flame detecting apparatus, which includes a detecting element for detecting a flame and means for scanning and driving the detecting element in a horizontal direction and a vertical direction, for searching the supervising zone and outputting data concerning the flames; a storage section for storing the detection data from the flame detecting apparatus; a fire extinguishment controlling section which compares and decides the sizes of the distributed flames on the basis of the storage data from said storage section; a nozzle assembly including a nozzle adapted to be directed towards the position of the flame starting within the supervising zone so as to discharge fire extinguishing liquid thereto for effecting fire extinguishing and means for controlling the direction of the nozzle in response to an control from the fire extinguishment controlling section.

More particularly, the present invention is based on such a finding that an energy detected from the actual flame is larger than an energy obtained through reflection and it is so arranged that the sizes of the flames are measured in terms of the magnitudes of the detected energies and the nozzle is controlled to direct toward the flame of largest energy for extinguishing the same after comparison of the sizes of the flames.

DETAILED DESCRIPTION OF PREFERRED EMBODIMENT OF THE INVENTION

Figure 1:
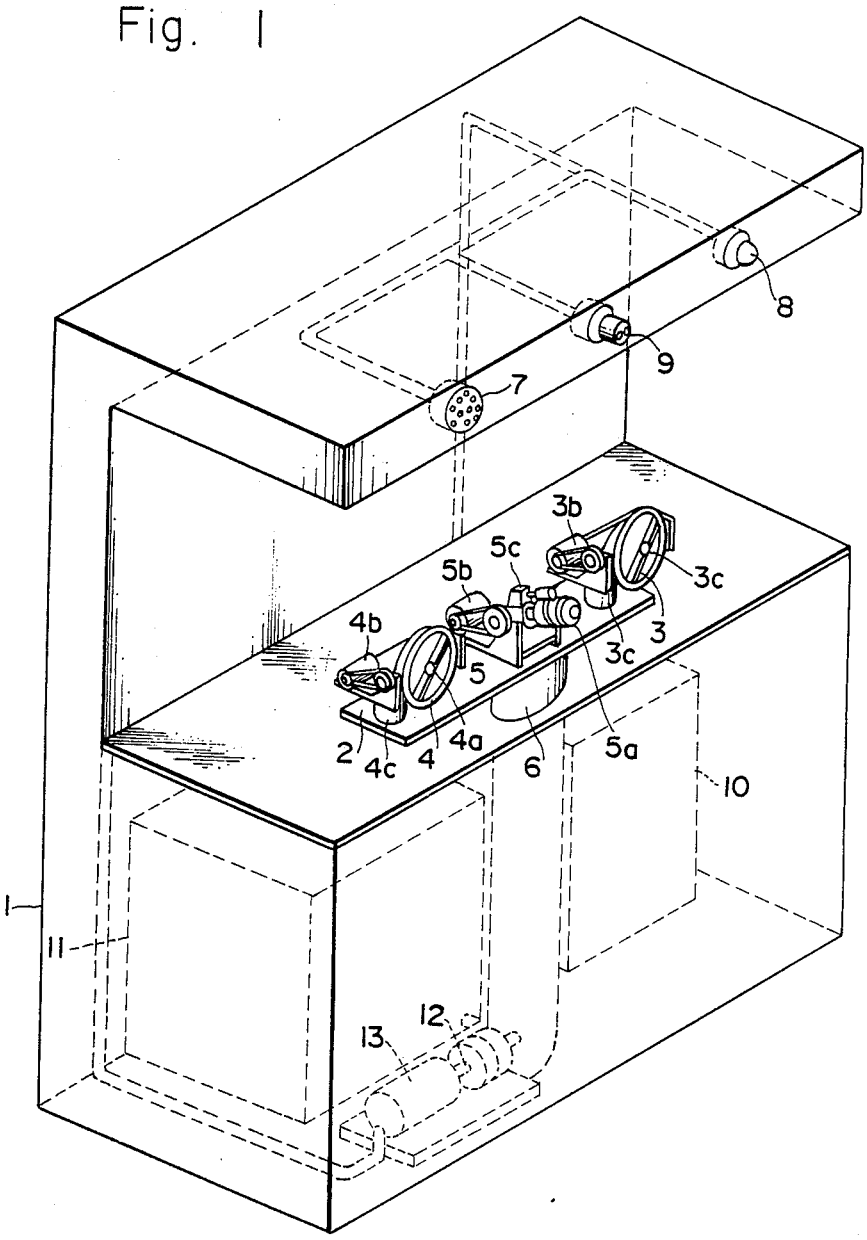
FIG. 1 is a perspective view of one preferred embodiment of the present invention.

Preferred embodiment of the present invention will now be described referring to the drawings.

The entire structure of the first embodiment will first be described referring to FIGS. 1 and 2. 1 is an automatic fire extinguishing equipment and a pair of flame detecting apparatuses 3 and 4 are disposed on a table 2, keeping a distance therebetween. One of the flame detecting apparatuses 3 comprises a detecting element 3*a* for detecting a flame, a vertical control means 3*b* for controlling the detecting element 3*a* in the vertical direction, and a horizontal control means 3*c* for controlling the detecting element 3*a* in the horizontal direction. Another flame detecting apparatus 4 similarly comprises a detecting element 4*a* for detecting a flame, a vertical control detector 4*a* for detecting a flame, a vertical control means 4*b* for controlling the detecting means 4*a* in the vertical direction and a horizontal control means 4*c* for controlling the detector 4*a* in the horizontal direction.

Each of the detecting elements 3*a* and 4*a* includes an infrared detector which detects an infrared light energy radiated from a flame in an analog form and outputs flame detecting data corresponding to the energy radiated from the flame, i.e., the intensity of the infrared ray.

The vertical control means 3b, 4b and the horizontal control means 3c, 4c each separately control the corresponding detectors 3a, 4a, respectively, so as to drive the detecting elements 3a, 4a in the vertical direction and in the horizontal direction in response to an instruction from a control section as will be described in detail later for detecting the position of the flame.

5 is a nozzle assembly disposed around a rotational center of the table 2 and it comprises a nozzle 5a for spraying fire extinguishing liquid, a spraying direction control means 5b for directing the nozzle 5a towards the flame position detected by the flame detecting apparatuses 3, 4, and a spraying condition control means 5c for controlling the spraying condition by adjusting the opening degree of the spout of the nozzle 5a according to the distance to the flame. 6 is a direction control means for controlling the rotation of the table 2 in the horizontal direction so as to direct the flame detecting apparatuses 3, 4 and the nozzle assembly 5 conjointly towards the flame.

7 is a buzzer, 8 is a lamp and 9 is a fire supervising section for supervising the entire zone. When the fire supervising section 9 detects a flame due to a fire, it outputs fire detection data to a circuitry section 10.

The fire detection data from the fire supervising section 9 is output to the control section through an input interface 15 included in the circuitry section 10. The control section 17 makes determination of a fire on the basis of the detection data from the fire supervising section 9 and when it makes fire determination, it gives a series of control operation as well as an instruction for alarm indication through actuation of an alarming section, such as driving of the buzzer 7 and lighting of the lamp 8. The control section 17 is input, through the input interface 15, with the detection data from the flame detecting apparatuses 3, 4, i.e., an analog detection signal from each of the detecting elements 3a, 4a and it computes the sizes of flames distributed within the supervising zone on the basis of the detection data from the flame detecting apparatuses 3 and 4 which make searches in the supervising zone. The computation result is output to the storage section 14. In the storage section 14, the infrared light energies of the flames distributed within the supervising zone are stored in an analog form, at respectively alloted addresses, on the basis of the data from the control section 17. The control section includes the fire extinguishment controlling section 17a which compares and determines the sizes of the distributed flames on the basis of the storage data from the storage section 14 and specifies, on the basis of the determination result, the flame to be preferentially extinguished, i.e., the largest flame of the plural distributed flames to control the extinguishing of the same. For the control section 17, a fire extinguishing program for the fire extinguishment controlling section 17a, programs such as a computing program for computing the size and the position of the flame, etc. have been set, and it outputs, on the basis of the preliminarily set control program, a control signal to the flame detecting apparatuses 3, 4 and the nozzle assembly 5 through an output interface 16 so as to effect control.

Figure 2:
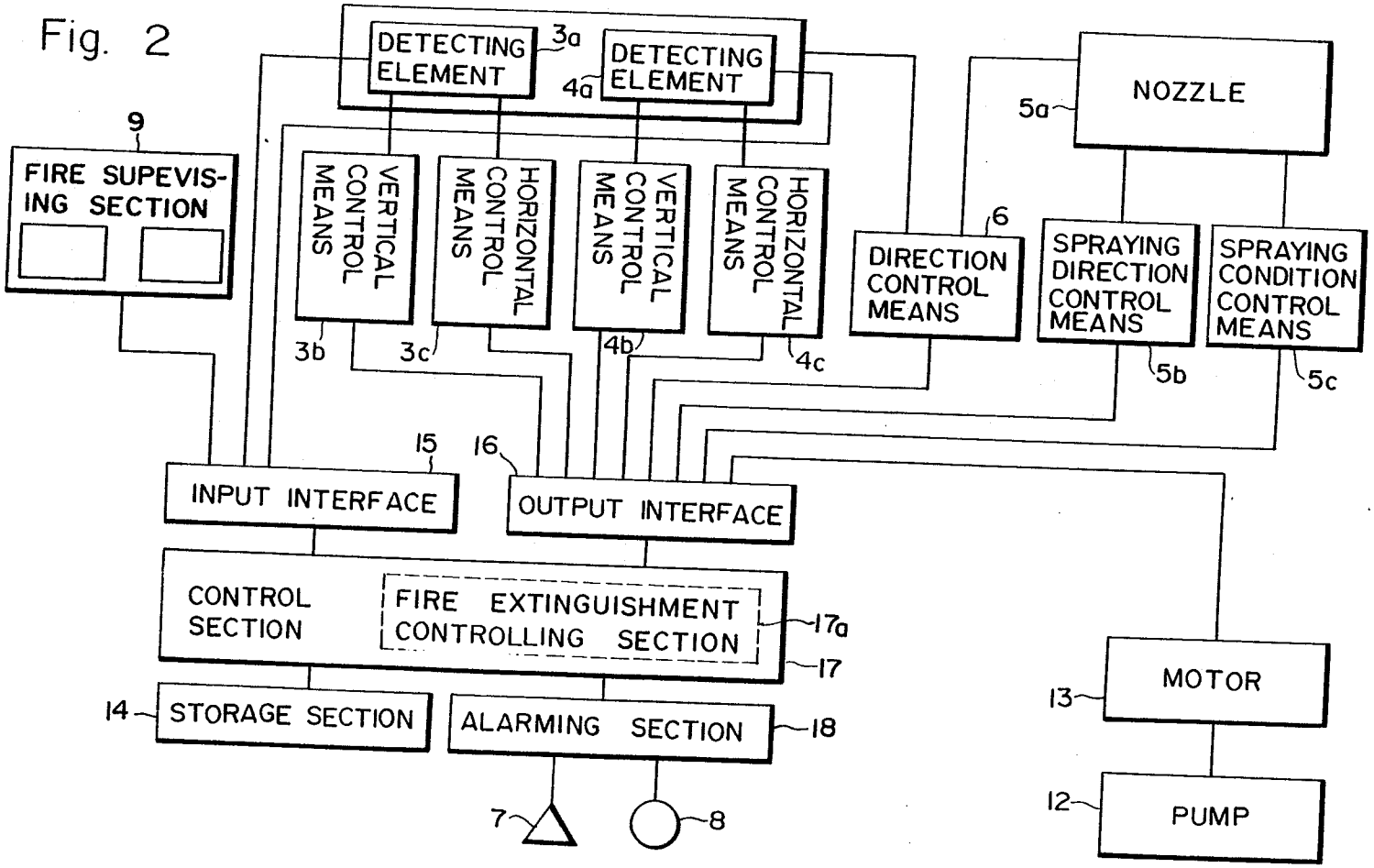
FIG. 2 is a block diagram showing a circuit arrangement of the embodiment illustrated in FIG. 1.

In FIG. 1, 11 is a tank for storing fire extinguishing liquid such as a fire extinguishing agent or fire extinguishing water, 12 is a pump for feeding the fire extinguishing liquid from the tank 11 to the nozzle 5a, and 13 is a motor. When the motor 13 is actuated on the basis of the control from the control section 17 obtained through the output interface 16, the fire extinguishing pump 12 is driven so as to feed the fire extinguishing liquid to the nozzle 5a for initiating a fire extinguishing operation.

Figure 3:
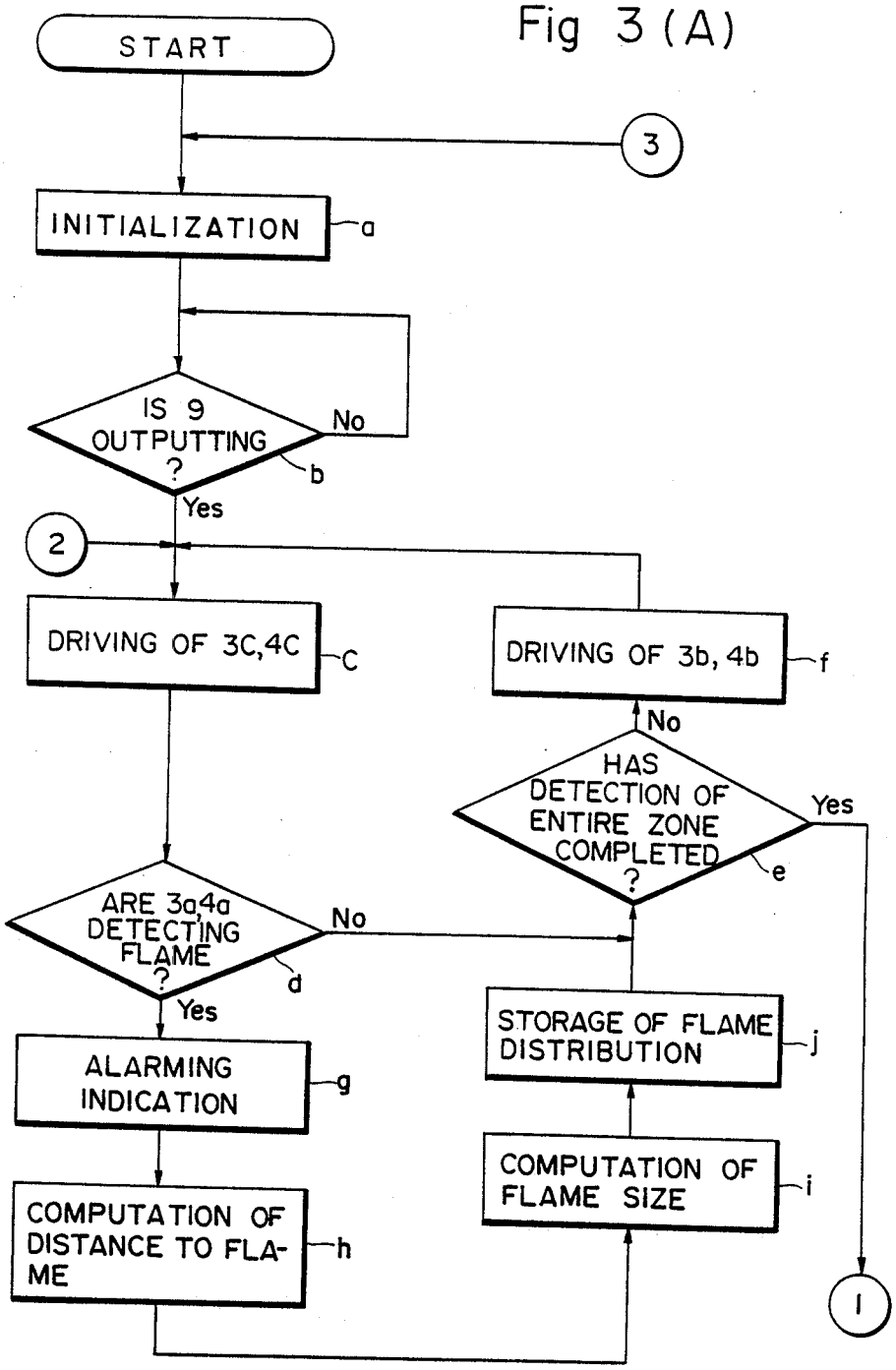
FIG. 3(A) and FIG. 3(B) are flowcharts.
Figure 3:
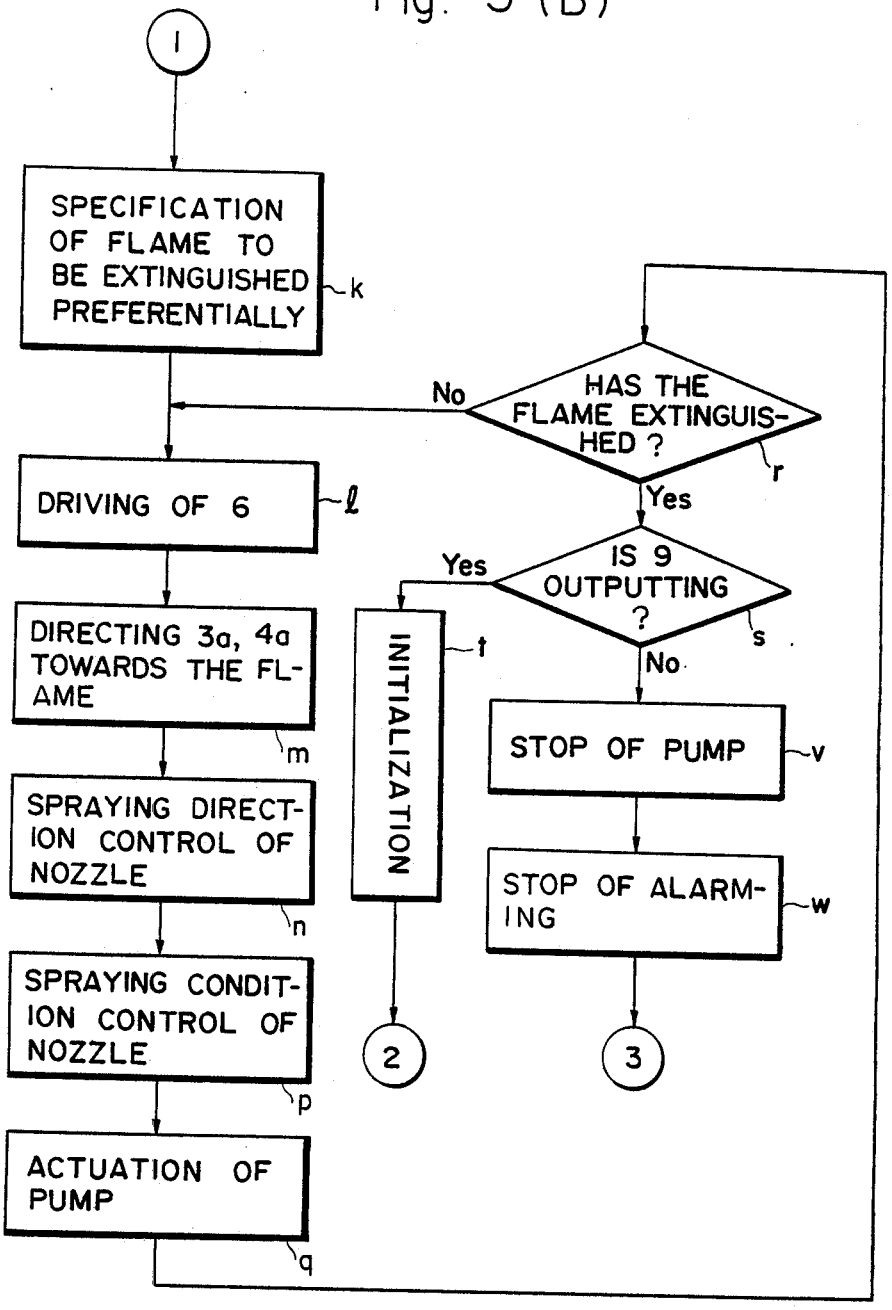
Figure 4:
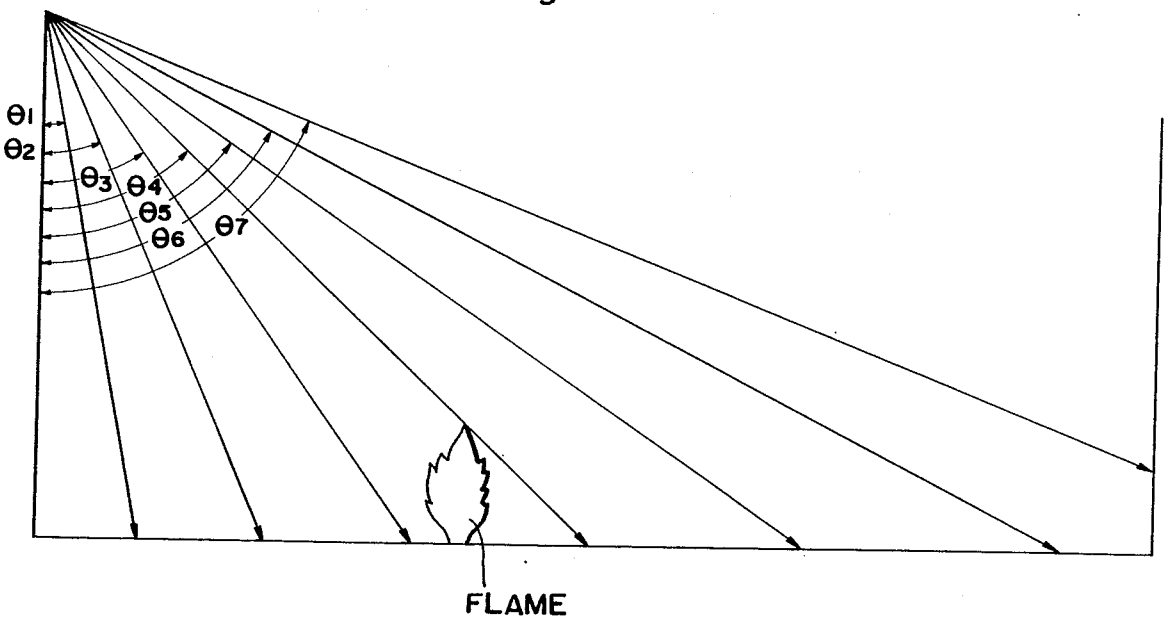
FIG. 4 is an explanatory diagram showing the direction of a nozzle.

The operation will be described referring to FIGS. 3(A) and 3(B) and FIG. 4. In FIG. 3(A), at block a, initialization for a normal time is made. For example, the vertical direction control means 3a, 4a are controlled so that the deflection angles of the detecting element 3a, 4a may be vertically downward angles. At block b, the fire supervising section supervises a fire occurring within the supervising zone and when the fire supervising section 9 detects a fire, the step proceeds from block b to block c. At block c, the horizontal direction control means 3c, 4c are driven. More particularly, horizontal scanning is made for searching flames while keeping the deflection angles in the vertical direction of the detecting elements 3a, 4a at the set vertically downward angles. At block d, determination is made as to whether the detecting elements 3a, 4a detect flames and if flames are not detected, the step proceeds to block e. At block e, determination is made as to whether flame detection of the entire supervisory zone has been completed or not, and as the flame detection of the entire supervising zone has not be completed, the step proceeds to block f. At block f, the vertical direction control means 3b, 4b are driven to reset the deflection angles in the vertical direction of the detecting elements 3a, 4a upwardly by a predetermined angle $\theta_1$ from the initial angle, i.e., the vertically downward angles. The step further proceeds to block c to again drive the horizontal direction control means 3c, 4c to continue the flame detecting operation. More particularly, horizontal scanning within the supervising zone is made while keeping the deflection angle reset at block f.

Similarly, the deflection angles in the vertical direction of the detecting elements 3a, 4a are stepwise reset upwardly from $\theta_2$ ti $\theta_7$ according to a preset deflection angle setting program and the detecting elements 3a, 4a are caused to scan in the horizontal direction at each of their deflection angles to repeat a flame detecting operation of the entire supervising zone.

When the detecting operations by the detecting elements 3a, 4a proceed and if at least one of the detecting elements 3a, 3b detects an infrared light energy from a flame, the step proceeds from block d to block g to drive the alarming section 18 for effecting an alarming indication. At block h, the distance to the flame is computed by the trigonometrical survey on the basis of the detection data from the detecting elements 3a, 4a. At block i, the size of the flame is likewise computed on the basis of the detection data from the detecting elements 3a, 4a. At block j, the computed distance to the flame and the computed size of the flame together with the address indicating the position of the flame are stored in the storage section 14. At block e, supervision is made as to whether flame detection of the entire supervising zone has been completed or not and when the flame detection of the entire supervising zone has been completed, the step proceeds from block e to block k of FIG. 3(B) through ①.

At block k, if a plurality of flames exist in the supervising zone, the size of the distributed flames are compared and determined on the basis of the storage data from the storage section 14 and the flame to be preferentially extinguished is specified on the basis of the determination result. More particularly, the position of the largest flame of the plural flames is specified and the step proceeds to block 1. At block 1, the direction control means 6 is driven to control the rotation of the table 2 so as to face the flame detecting apparatuses 3, 4 and the nozzle assembly 5 conjointly towards the flame to be extinguished. At block m, the horizontal angles of the detecting elements 3*a*, 4*a* are readjusted because the angles are deviated from the flames to be extinguished according to the rotation of the table 2 and the vertical direction control means 3*b*, 4*b* and the horizontal direction control means 3*c*, 4*c* are driven to direct the detecting elements 3*a*, 4*a* towards the largest flame to be extinguished. At block n, the spraying direction control means 5*b* of the nozzle assembly 5 is driven to adjust the directing angle in the vertical direction of the nozzle 5*a* so as to direct the spout of the nozzle 5*a* towards the flame to be extinguished. At block p, the spraying condition control means 5*c* of the nozzle assembly 5 is driven to adjust the opening degree of the spout of the nozzle 5*a* for controlling the spraying condition of the fire extinguishing liquid. More particularly, the opening of the spout is set according to the size of the flame to be extinguished and the distance to the flame. At block q, the motor 13 is actuated to operate the fire extinguishing pump 12 so as to discharge the fire extinguishing liquid from the nozzle 5*a* for starting a fire extinguishing operation. At block r, supervision is made as to whether the corresponding flame has been extinguished or not on the basis of the data from the detecting elements 3*a*, 4*a*. When the flame has not been completely extinguished, the step proceeds to block 1 and block m so as to readjust the direction control means 6 and the vertical direction control means 3*b*, 4*b* and the horizontal direction control means 3*c*, 4*c*. Further, at block n and block q, the spraying direction and spraying condition of the nozzle 5*a* are readjusted to continue the fire extinguishing operation. At block r, if it is confirmed that the corresponding flame has been completely extinguished, the step proceeds to block s for making determination as to if there is any flame within the supervising zone. More particularly, if detection data is obtained from the fire supervising section 9, the step proceeds from block s to block t for making initialization and the step further proceeds to block c of FIG. 3(A) through ② for controlling flame detection of the entire supervising zone.

If the largest flame, i.e., the actual flame is extinguished, a virtual image flame obtained from an infrared ray emitted from the actual flame which has been reflected from a floor or window pane of high reflectance is also extinguished simultaneously. As a result, no output is obtained from the fire supervising section 9 and the step proceeds from block s to block v to stop the fire extinguishing pump 12 for terminating the fire extinguishing operation. At block w, the buzzer 7 and the lamp 8 are turned off to stop the alarming and the step returns to block a of FIG. 3(A) through ③ for resetting the directing angles of the detecting elements 3*a*, 4*a* to the initial conditions, respectively, for continuously conducting the fire supervision.

Figure 5:
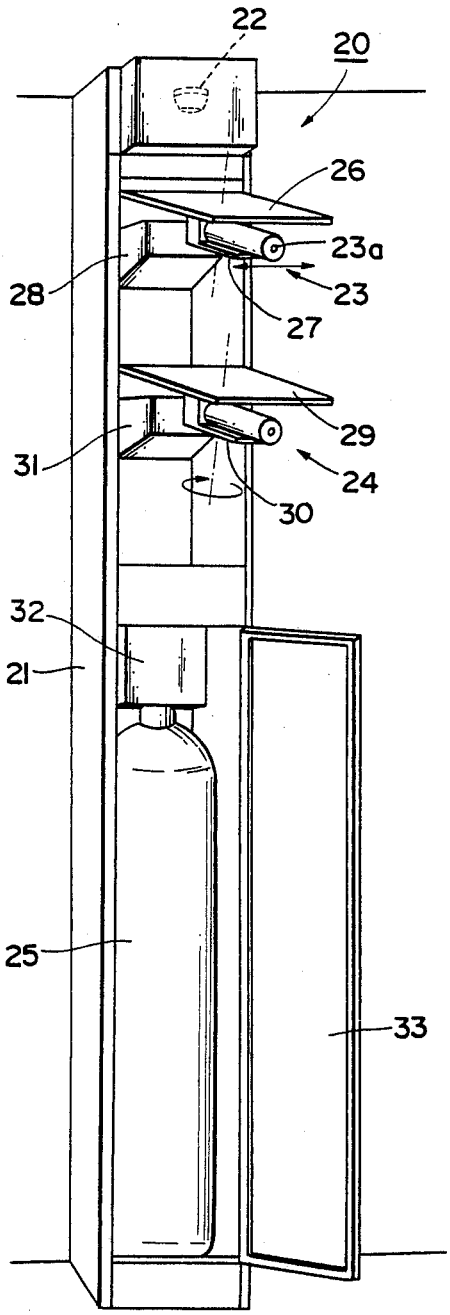
FIG. 5 is an entire structure of another embodiment of the present invention.

A second embodiment will now be described, referring to FIGS. 5 to 7.

In this embodiment, a single flame detecting apparatus is used for detecting the size and the position of a flame. Stated more illustratively, an automatic fire extinguishing equipment 20 of this embodiment comprises an elongated casing 21 and a smoke detector 22 disposed at a top portion of the casing 21, a nozzle assembly 23, a flame detecting apparatus 24 and a fire extinguishing agent bomb 25 which are disposed within the casing 21 in this order.

The smoke detector 22 corresponds to the fire supervising section for entire supervision in the foregoing embodiment, and it may for example be an ionization-type smoke detector. Of course, another type of smoke detector may alternatively be employed.

The nozzle assembly 23 is mounted on the rear side of a cover 26 through a base 27 and a nozzle 23*a* is freely rotatable in the horizontal and vertical directions by a drive 28 disposed within the casing 21. The drive 28 includes a vertical direction control means 23*b* and a horizontal direction control means 23*c* for controlling the directions of the nozzle 23*a* as in the foregoing embodiment. However, a spraying condition controlling means for the nozzle 23*a* is omitted to simplify the apparatus.

The flame detecting apparatus 24 is also mounted on the rear side of a cover 29 through a base 30 in a similar manner to that of the nozzle assembly 23 and a detecting element 24*a* including an infrared detector may be rotated in the horizontal and vertical directions by a drive 31 disposed within the casing 21. However, the rotation in the horizontal direction is one directional so as to simplify the construction of the apparatus. The drive 31 also includes a vertical direction control means 24*b* and a horizontal direction control means 24*c* as in the foregoing embodiment. However, they differ from those of the foregoing embodiment in that they suffice to be such ones that can output the direction angles as data.

More particularly, when the smoke detector 22 detects smoke and generates a fire signal, the detecting element 24*a* of the present embodiment rotates a bit upwardly in the vertical direction to push the cover 29 upwardly and to assume a first deflection angle position set to substantially vertically downward direction. Then, the detecting element 24*a* rotates while keeping the state and rotates upwardly by the vertical direction control means 24*b* so as to assume a second deflection angle while it is directed within the casing 21. A series of the operations such as the rotation, scanning and changing of the deflection angle are sequentially repeated for effecting the scanning of the entire supervising zone.

The fire extinguishing bomb 25 contains a given amount of a fire extinguishing agent including water and chemicals and a gas of a predetermined pressure and is provided at the top thereof with a solenoid valve 32. The fire extinguishing bomb 25 is connected to the nozzle 23*a* through the electromagnetic valve 32 and when the solenoid valve 32 is opened, the fire extinguishing agent is fed to the nozzle 23*a* by the pressure of the gas.

Figure 6:
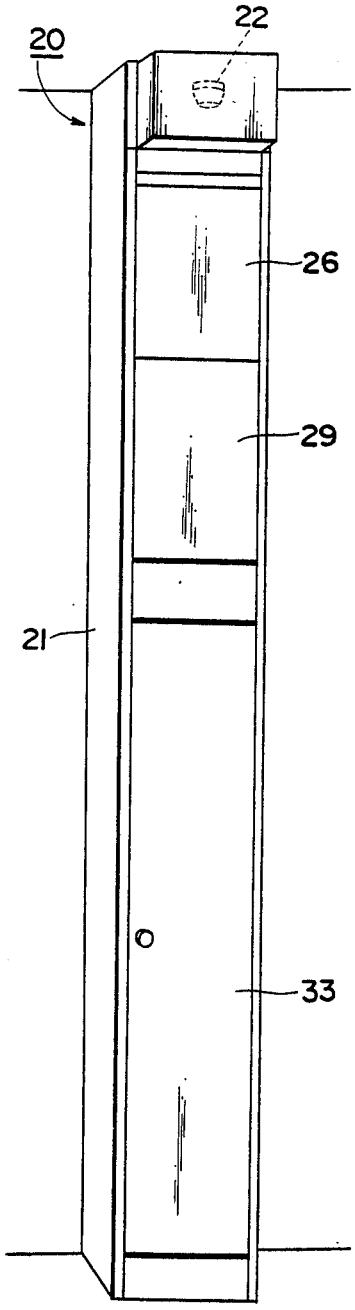
FIG. 6 is a perspective view of the structure of the embodiment illustrated in FIG. 5, showing it in its non-operating state.
Figure 7:
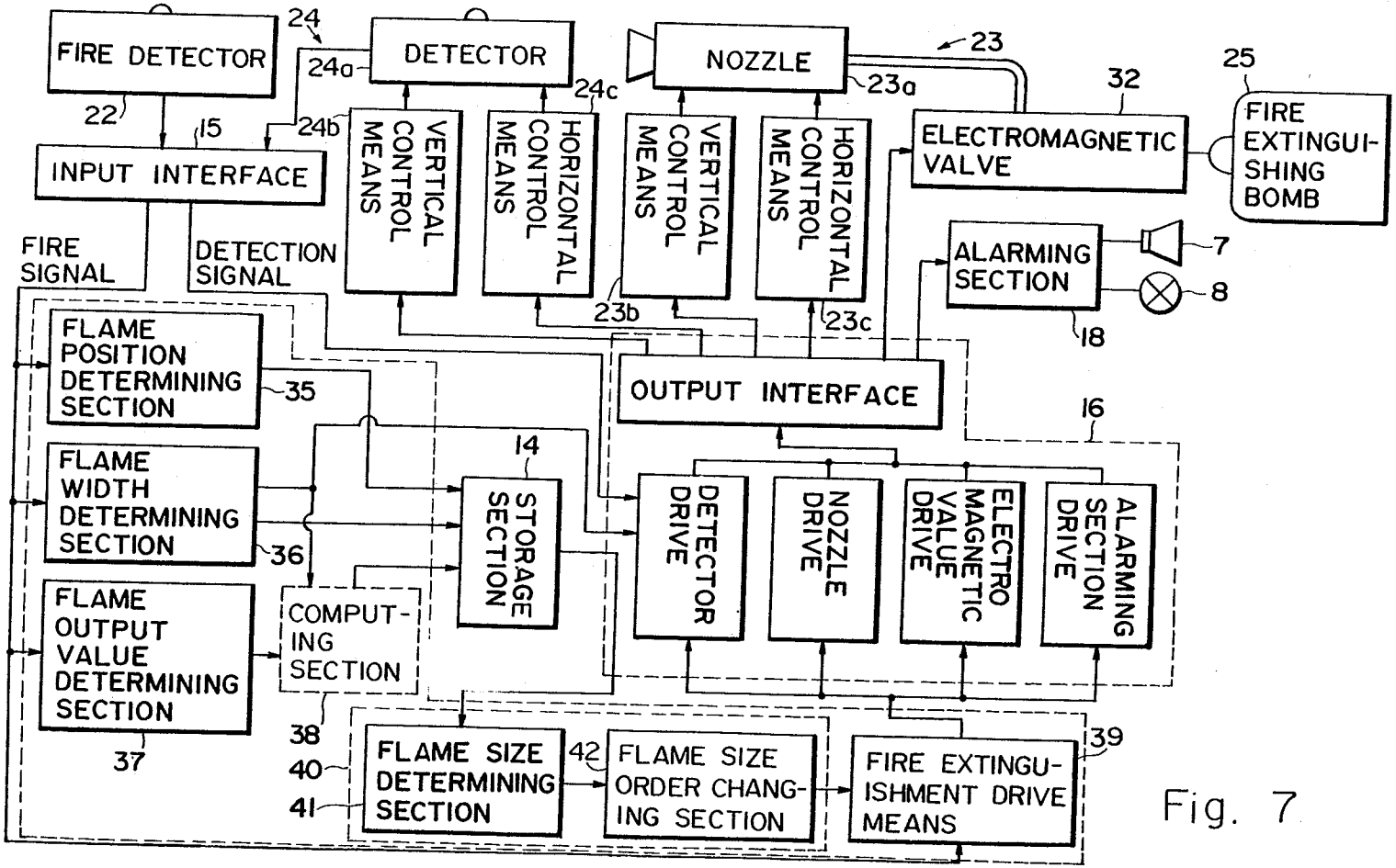
FIG. 7 is a block diagram of a circuit arrangement of the embodiment illustrated in FIG. 5.

In this connection, it is to be noted that the cover 26 for the nozzle assembly 23 and the cover 29 for the flame detecting apparatus 24 may be closed together with the corresponding apparatus and assembly, respectively, and under the condition where the smoke detector 22 is not detecting smoke, they are closed as shown in FIG. 6. Of course, a cover for the fire extinguishing agent bomb 25 may be normally closed and openable manually when required.

The circuit arrangement of the present invention will be described referring to FIG. 7. In FIG. 7, portions similar to or same as those of FIG. 2 are designated by the similar or same numerals. The explanation of the same or similar portions are omitted here.

A control section 34 of the present embodiment comprises a flame position determining section 35, a flame width determining section 36, a flame output value determining section 37, a computing section 38, a fire extinguishing drive control section 39 and a fire extinguishment controlling section 40.

Each of the determining sections 35, 36 and 37 is input with detection data from the flame detecting apparatus 24, i.e., an analog detection signal from the detecting element 24*a*. The flame position determining section 35 determines the position of the flame from the directing angle in the vertical direction of the detecting element 24*a* and the rotational angle in the horizontal direction thereof when the detecting element 24*a* receives infrared energy from the flame and from the position in height where the flame detecting apparatuses are installed, and outputs the determination data to the storage section 14. The flame width determining section 36 transmits a control signal to the vertical direction control means of the flame detecting apparatus 24 through a detecting element drive in the output interface 16 when a flame detection signal is input to the detecting element 24*a*. When the vertical direction control means 24*b* receives the control signal, it stops changing the deflection angle of the detecting element 24*a*, so that the detecting element 24a makes a predetermined number of turns while keeping the deflection angle at the time when it outputs the detection signal for repeating scanning of the same area of the supervising zone several times.

This operation is adapted to the phenomenon of a flame, i.e., so called a flickering phenomenon of a flame by which the width of the flame varies largely within a short period of time. More specifically, during the rotation of the detecting element 24*a*, while keeping the same deflection angle, if the flame detection signals are output at different angles, the determination is made that the detection signals represent an actual flame. In other cases, the detection signals are determined as being false one due to, for example, the sunlight.

The flame width determining section 36 outputs data concerning the width of the flame to the storage section when the detection by the detecting element 24*a* is determined as an actual flame, and generates an output to the vertical direction control means 24*b* which has suspended the changing of the deflection angle of the detecting element 24*a* so as to sequentially changing the deflection angles of the detecting element 24*a*. In this connection, it is to be noted that since the flickering of the flame also varies the height of the flame, a flame height determining section may alternatively be provided in place of the flame width determining section 36.

The flame output determining section 37 determines the output values of the flame input from the detecting element 24*a* in the form of the intensities of the infrared energies and outputs predetermined signal values to the computing section 38.

The computing section 38 is a circuit which integrates the output values of the flame output over the width of the flame and computes the average value thereof. The obtained average value is output to the storage section 14 as an output value of the flame. The storage section 14 stores, as in the foregoing embodiment, the position, width and output value of the flame at the respective addresses. The computing section 38 may employ a peak value holding circuit so that the maximum value of the output values of the flames may be output to the storage section 14.

The fire extinguishment controlling section 40 comprises a flame size comparing and determining section 41 and a fire extinguishment preference determining section 42. The flame size comparing and determining section 41 compares and determines the sizes of the distributed flames on the basis of the storage data from the storage section 14. More specifically, the positions of the flames input from the flame position determining section 35 to the storage section and stored therein are combined with the output values and the widths (or heights) of the flames to correct the output values or widths (or height) of the flames according to the positions of the flames so as to effect accurate flame size comparison. More concretely, since the light energies reaching to the detecting element 24*a* differ when the distances between the flames and the flame detecting apparatus 24 and the angles of view from the detecting element 24*a* also differ, they are corrected so as to enable accurate flame size comparison. The combinations of the data are the width of the flame and the position of the flame; the output value of the flame and the position of the flame; and the width of the flame, the output value of the flame and the position of the flame. Of course, the height of the flame may alternatively be employed instead of the width of the flame.

The fire extinguishment preference determining section 42 determines the preference of the flames to be extinguished on the basis of the output from the flame size comparing and determining section 41. It generates an output to control the fire extinguishment drive control section 39 so as to start the fire extinguishment preferentially from the flame which has been determined as being the largest. The fire extinguishment drive control section 39 drives relevant devices and equipments through a nozzle drive section, a solenoid valve drive section and an alarming section drive section of the output interface 16.

While the output from the fire supervising section 9 is also input to the control section through the input interface 15 so as to drive the flame detecting apparatuses based on the determination by the control section 17 in the foregoing embodiment, fire signal is immediately input from the input interface 15, when the smoke detector generates an output, the detecting element drive section of the output interface for driving the fire detecting apparatus 24 in the present embodiment.

Although the operation flowchart of the present embodiment is not shown, it is substantially the same as the flowchart shown in FIGS. 3(A) and (B) for the foregoing embodiment.

In both the embodiments as described above, the entire supervising zone is again searched whenever the flame to be extinguished, i.e., the largest flame has been extinguished, but alternatively the order of the flames to be extinguished may be set so that when the flame to be first extinguished has been extinguished, the detecting element may be directed to the flame to be extinguished secondly for determining as to whether the flame is an actual flame or a virtual image flame. In this case, the fire extinguishment activity may be carried out quickly.

Furthermore, although the preference for fire extinguishment is given in the order of the flame size which determine in accordance with processed output from the detecting element showing a strength of energy intensity radiated from a flame in these embodiment, the preference may alternatively be given in the order of energy intensity radiated from a flame without the determination of the flame size. Or, when the determination is made for plural flames to have substantially the same flame size, the preference for fire extinguishment may be given to the flame having more intense energy. In this case, the fire extinguishment is carried out more effectively.

We claim:

1. An automatic fire extinguishing equipment comprising:

means for detecting flames in a supervised zone and producing a detecting signal;

a flame detecting apparatus including:

a first detecting element for detecting infra-red radiation from flames occurring within said zone and which produces fire signals corresponding to the energy of said radiation;

scanning means for driving the first detecting element in horizontal and vertical directions so as to scan the entire zone for such flames in response to said detecting signal; and control means responsive to the fire signals to produce data concerning each flame in said zone;

a storage section for storing the detection data produced by the flame detecting apparatus;

a fire extinguishment controlling section which, from the detection data stored in the storage section, determines the relative sizes of the flames in said zone;

a nozzle assembly including a nozzle for discharging a fire extinguishing liquid to extinguish the flames; and means for controlling the positioning of the nozzle to direct the fire extinguishing liquid towards the largest flame in said zone.

2. An automatic fire extinguishing equipment in accordance with claim 1, wherein the fire extinguishment controlling section includes means for comparing the relative sizes of the flame scanning position data on the basis of combinations of the detection data stored in the storage section for each flame.

3. An automatic fire extinguishing equipment in accordance with claim 2, wherein the flame detecting apparatus further comprises a second detecting element for detecting infrared radiation from flames within said supervised zone and produces signals corresponding to the energy of such radiation; such second detecting means also being driven by the scanning means to scan the flames; the signals from the first and second detecting elements enabling the control means to trigonometrically calculate the locations of the flames.

4. An automatic fire extinguishing equipment in accordance with claim 3, wherein each of said detecting element produces analog signals corresponding to the infrared energy radiated from the flames.

5. An automatic fire extinguishing equipment in accordance with claim 3, wherein the flame detecting apparatus determines the locations of the flames on the basis of the horizontal and vertical angles from each flame to each detecting element.

6. An automatic fire extinguishing equipment in accordance with claim 1, wherein said scanning means causes the first detecting element to repeatedly scan the flames several times while keeping the same scanning angle in the vertical direction, and said first detecting element generates a fire signal when there is a difference between the horizontal flame detection angles due to flickering of the flames.

* * * * *